US010392979B2

(12) United States Patent
Semura et al.

(10) Patent No.: US 10,392,979 B2
(45) Date of Patent: Aug. 27, 2019

(54) INNER FIN FOR HEAT EXCHANGER

(71) Applicant: Tokyo Radiator MFG. Co., Ltd., Fujisawa-shi, Kanagawa (JP)

(72) Inventors: Kenta Semura, Fujisawa (JP); Tetsu Yokoo, Fujisawa (JP)

(73) Assignee: Tokyo Radiator MFG. Co., Ltd., Fujisawa-shi, Kanagawa (JP)

( * ) Notice: Subject to any disclaimer, the term of this patent is extended or adjusted under 35 U.S.C. 154(b) by 32 days.

(21) Appl. No.: 15/740,686

(22) PCT Filed: Jun. 28, 2016

(86) PCT No.: PCT/JP2016/069173

§ 371 (c)(1),
(2) Date: Dec. 28, 2017

(87) PCT Pub. No.: WO2017/002819

PCT Pub. Date: Jan. 5, 2017

(65) Prior Publication Data

US 2018/0195424 A1 Jul. 12, 2018

(30) Foreign Application Priority Data

Jun. 30, 2015 (JP) ..... 2015-130837

(51) Int. Cl.
*F28D 15/00* (2006.01)
*F01N 3/02* (2006.01)
(Continued)

(52) U.S. Cl.
CPC ..... *F01N 3/0205* (2013.01); *F28D 7/1684* (2013.01); *F28D 21/0003* (2013.01);
(Continued)

(58) Field of Classification Search
CPC .. F01N 3/0205; F28D 7/1684; F28D 21/0003; F28D 3/02; F28D 15/043;
(Continued)

(56) References Cited

U.S. PATENT DOCUMENTS 7,770,633 B2 * 8/2010 Miyahara ..... F28D 15/046 165/128
2006/0048921 A1 3/2006 Usui et al.
(Continued)

FOREIGN PATENT DOCUMENTS

CN 1749684 A 3/2006
CN 101517347 A 8/2009
(Continued)

OTHER PUBLICATIONS

Oct. 31, 2018—(EP) Extended Search Report—App 16817927.3.
(Continued)

*Primary Examiner* — Davis D Hwu
(74) *Attorney, Agent, or Firm* — Banner & Witcoff, Ltd.

(57) ABSTRACT

In an inner fin, a plate is made up of a top part, a bottom part, and a wall plate part, and a channel having a concave-shaped cross section and a channel having an inverted concave-shaped cross section are alternately repeated as channels of the gas by a pair of the wall plate parts facing each other. The wall plate part for each of the channels has a shape in which the wall plate part is bent left and right in a serpentine shape and projected and recessed parts thereof are alternately repeated and formed, and the recessed part of the wall plate part is formed with a chevron-shaped part made up of an upward slope part that ranges from a base part to the top part and a downward slope part that passes downward from the top part to a neighboring base part.

8 Claims, 7 Drawing Sheets

(51) Int. Cl.

| | |
|---|---|
| ***F28F 1/40*** | (2006.01) |
| ***F28F 1/02*** | (2006.01) |
| ***F28F 3/02*** | (2006.01) |
| ***F28D 7/16*** | (2006.01) |
| ***F28D 21/00*** | (2006.01) |
| *F28D 3/02* | (2006.01) |
| *F28F 3/04* | (2006.01) |

(52) U.S. Cl.
CPC ..... *F28F 1/02* (2013.01); *F28F 1/40* (2013.01); *F28F 3/025* (2013.01); *F28D 3/02* (2013.01); *F28F 3/042* (2013.01); *F28F 2215/10* (2013.01)

(58) Field of Classification Search
CPC ... F28D 15/046; F28F 1/02; F28F 1/40; F28F 3/025; F28F 3/042; F28F 2215/10; F28F 1/32
USPC ..... 165/104.11
See application file for complete search history.

(56) References Cited

U.S. PATENT DOCUMENTS

| | | | | |
|---|---|---|---|---|
| 2008/0011464 | A1 | 1/2008 | Oofune et al. | |
| 2010/0025025 | A1 | 2/2010 | Tomochika et al. | |
| 2010/0073866 | A1* | 3/2010 | Toyoda | F28D 15/043 361/679.47 |
| 2011/0094722 | A1 | 4/2011 | Mori et al. | |
| 2016/0069623 | A1 | 3/2016 | Iwasaki et al. | |
| 2016/0320147 | A1* | 11/2016 | Wang | F28F 1/32 |

FOREIGN PATENT DOCUMENTS

| | | | |
|---|---|---|---|
| CN | 102054808 | A | 5/2011 |
| JP | H04-332392 | A | 11/1992 |
| JP | H05-017367 | U | 3/1993 |
| JP | 2000-055583 | A | 2/2000 |
| JP | 2008-096048 | A | 4/2008 |
| JP | 4240136 | B2 | 3/2009 |
| JP | 2011-112331 | A | 6/2011 |
| JP | 5558206 | B2 | 7/2014 |
| JP | 2014-224669 | A | 12/2014 |
| JP | 2015-078819 | A | 4/2015 |
| WO | 2006/116857 | A1 | 11/2006 |
| WO | 2014/175158 | A1 | 10/2014 |

OTHER PUBLICATIONS

Sep. 27, 2016—International Search Report—Intl App PCT/JP2016/069173.
Mar. 11, 2019—(CN) The First Office Action—App 2016800393703, Eng Tran.

* cited by examiner

INNER FIN FOR HEAT EXCHANGER

CROSS REFERENCE TO RELATED APPLICATIONS

This is a U.S. National Phase Application under 35 U.S.C. § 371 of International Application No. PCT/JP2016/069173, filed Jun. 28, 2016, which claims priority to Japanese Application No. 2015-130837 filed Jun. 30, 2015, which was published Under PCT Article 21(2), the entire contents of which are incorporated herein by reference.

TECHNICAL FIELD

The present invention relates to an inner fin that is mounted in a heat exchanger such as an EGR cooler and accelerates heat exchange of an exhaust gas or the like.

BACKGROUND ART

In the related art, an EGR device that forces a part of an exhaust gas to flow back to the intake system of an engine and reduces generation of a nitrogen oxide has been developed as a heat exchanger. The EGR device is provided with an EGR cooler for cooling the exhaust gas, and the EGR cooler is mounted between the exhaust and intake systems of the engine of a vehicle.

As the EGR cooler, a plate tube type cooler has numerous flat plate tubes that are inserted into and installed in a shell formed as a cylinder, and performs heat exchange between an exhaust gas flowing inside the tubes and a coolant flowing outside the tubes.

Each of the tubes is used as a tube in which an inner fin is inserted into a flat tube main body that is extruded and is molded in a hollow shape by rolling or the like, or that is formed of members divided into two upper and lower parts, and the tube main body and the inner fin are brazed.

In the related art, an inner fin for a heat exchanger is disclosed in, for instance, Patent Document 1. The inner fin is an inner fin which is mounted in a flat tube, in which a thin sheet forming the inner fin is formed in a serpentine shape in which each curved crest portion is alternately in contact with both inner walls of the flat tube facing each other, and which has a first corrugated shape in which an exhaust gas channel is formed between partitions and a second corrugated shape in which a wall of an accordion structure is formed. The inner fin is a so-called wavy fin, and is an inner fin that more hardly filled with soot than an offset fin.

A heat exchanger in which numerous fins are fixed inside a flat tube and numerous V-shaped strip portions at which a cross section of the fin in a circulating direction of a gas has a corrugated shape are bent is described in Patent Document 2. The heat exchanger is a heat exchanger in which one of a pair of oblique strip portions forming a V shape is inclined at an angle of $\alpha$ and is disposed on a positive side and the other is inclined at an angle of $\beta$ and is disposed on a negative side, and in which both the oblique strip portions are disposed at an asymmetrical angle. Thereby, large and small vortex flows are formed on a diagonal line inside a segment of each fin, and particulate matter of a trough portion or the like of the fin is effectively blown away.

An exhaust inner fin for a heat exchanger represented in Patent Document 3 is an offset fin in which, when viewed from a flow direction of an exhaust gas, a corrugated portion caused by a cut and raised portion is offset with respect to the neighboring corrugated portion. The exhaust inner fin has a shape in which a wall portion dividing an interior of a tube into a plurality of channels is disposed in a zigzag shape in the flow direction of the exhaust gas, and convex portions adjacent to each other in an exhaust flow direction are disposed out of alignment.

A fin for a heat exchanger represented in Patent Document 4 divides an exhaust passage into a plurality of segments that repeat a rugged shape in an exhaust flow direction and a direction perpendicular to a tube stacking direction and are formed in an offset shape in which they are alternately shifted in the exhaust flow direction at each predetermined length. A horizontal wall constituting each of the segments is formed by cutting and raising a plurality of projected plate.

PRIOR ART DOCUMENT

Patent Document

Patent Document 1: JP-A-2008-096048
Patent Document 2: Japanese Patent No. 5558206
Patent Document 3: Japanese Patent No. 4240136
Patent Document 4: JP-A-2014-224669

SUMMARY OF THE INVENTION

Problems that the Invention is to Solve

Meanwhile, the wavy fin such as the inner fin of Patent Document 1 has a problem that, since a channel cross-sectional area of a bent region of a serpentine shape in the flow direction of the exhaust gas becomes larger than an upstream channel cross-sectional area and is repeated at meandering periods, a flow velocity of the exhaust gas is reduced in a region in which the channel cross-sectional area is large, and an amount of heat exchange with a coolant is reduced.

In general, a vertical flow is hardly generated in the wavy fin. Since the inner fin is typically mounted in the flat tube, the heat exchange is active in a place close to a plate surface of the tube, but heat exchange efficiency is reduced in proportion to a distance from the plate surface of the tube due to development of a temperature boundary layer. Especially, since stainless steel that is a main material of the inner fin has low heat conductivity, a reduction in heat exchange efficiency becomes an issue as a vertical dimension (a longitudinal width of the tube) of the fin increases.

The fin of Patent Document 2 has a problem that a machining process is increased because of existence of an undercut part, and that dimensional accuracy is reduced because the undercut part is not pressed during machining (bending). Especially, since a plane (a brazing region) such as a top part or the like of the fin cannot be accurately molded in the rolling (the bending), a contact part with the tube becomes close to line junction, which is responsible for reducing a quality of the brazing and strength.

Both the inner fin of Patent Document 3 and the fin of Patent Document 4 are offset fins. These fins have an effect that a gas is hit against a cut line of offset and generates a turbulent flow and that an amount of heat radiation is improved by a gas side wet area. However, when these fins are used in an environment having much particulate matter (PM) such as the heat exchange of the exhaust gas such as the EGR cooler, these fins have a problem that the PM is hit against to the cut line (the front edge) of the offset, is accumulated to become heat resistance, and invites deterioration of heat exchange performance As illustrated in FIG. 10, a wavy fin 50 has a shape in which a channel meanders left and right (repeats a convex shape and a concave shape). In this case, there is a problem that an exhaust gas 51 flows across a convex-shaped region 52, and thereby a vortex in a return direction (a return vortex 56) occurs at a subsequent concave-shaped region 54, and soot or the like contained in a gas is stagnated and accumulated by the return vortex 56.

Considering the above, the problems of the inner fins in the related art occurs in activating the flow (in the vertical direction or the like) of the gas, and especially reinforcing the heat exchange (improvement of the heat exchange efficiency) in a place close to the tube, and in addition, preventing accumulation of soot, PM, etc. (reduce heat resistance and improve durability).

In recent years, to deal with stricter regulations of the exhaust gas, higher heat-radiation performance, a reduction in gas pressure loss, prevention of soot chocking, etc. are required for the EGR cooler or the other heat exchanger mounted in a vehicle.

The present invention was made in view of the above problems, and is directed to provide an inner fin for a heat exchanger that activates a flow of a gas to enhance heat exchange performance, and prevents soot chocking to provide excellent durability and high productivity.

Means for Solving the Problems

To achieve the above technical problems, as illustrated in FIGS. 1 and 2, an inner fin for a heat exchanger according to the present invention is an inner fin 2 that performs heat exchange of a gas, the inner fin being inserted into a tube 4 in which a space is flat between an upper plate part 6 and a lower plate part 8, and has a configuration in which: a plate is made up of a top part 10 that is in contact with the upper plate part 6 of the tube, a bottom part 12 that is in contact with the lower plate part 8 of the tube, and a wall plate part 14 that partitions a space between the top and bottom parts, and a channel having a concave-shaped cross section and a channel having an inverted concave-shaped cross section are alternately repeated as channels of the gas by a pair of the wall plate parts facing each other; the wall plate part 14 for each of the channels has a shape in which the wall plate part is bent left and right in a serpentine shape and projected and recessed parts 20 and 22 thereof are alternately repeated and formed; and the recessed part 22 of the wall plate part is formed with a chevron-shaped part 24 made up of an upward slope part 28 that bulges in a direction of the wall plate part facing the wall plate part and ranges from a base part 27 to the top part 25 and a downward slope part 29 that passes downward from the top part 25 to a neighboring base part 27.

As illustrated in FIG. 9, an inner fin for a heat exchanger according to the present invention is an inner fin 5 which performs heat exchange of a gas, the inner fin being inserted into a tube 4 in which a space is flat between an upper plate part and a lower plate part, and has a configuration in which: a plate is made up of a top part 10 that is in contact with the upper plate part 6 of the tube 4, a bottom part 12 that is in contact with the lower plate part 8 of the tube 4, and a wall plate part 14 that partitions a space between the top and bottom parts, and a channel having a concave-shaped cross section and a channel having an inverted concave-shaped cross section are alternately repeated as channels of the gas by a pair of the wall plate parts facing each other; the wall plate part for each of the channels has a shape in which the wall plate part is bent left and right in a serpentine shape and projected and recessed parts 20 and 22 thereof are alternately repeated and formed; and the recessed part 22 of the wall plate part is formed with an upward slope part 28 that bulges in a direction of the wall plate part facing the wall plate part and ranges from a base part 27 to the top part 25.

Here, the channel having a concave-shaped cross section is a concept that includes a V-shaped channel whose width is narrowed toward the bottom part or a U-shaped channel in which widths of the top and bottom parts thereof are approximately constant, and the channel having an inverted concave-shaped cross section is a concept that includes an inverted V-shaped channel whose width is narrowed toward the top part or an inverted U shape.

The inner fin for a heat exchanger according to the present invention has a configuration in which: the projected part of the wall plate part is formed with a valley-shaped part 26 made up of a downward slope part 29 that passes downward from a top part of the chevron-shaped part 24 to a base part thereof and an upward slope part 28 of another chevron-shaped part that is adjacent to the chevron-shaped part and is equally formed; and with respect to the chevron-shaped part 24 formed at the recessed part 22 of the wall plate part, the projected part 20 of the other wall plate part facing the wall plate part is formed with the valley-shaped part 26, and with respect to the valley-shaped part 26 formed at the projected part 20 of the wall plate part, the recessed part 22 of the other wall plate part is formed with the chevron-shaped part 24.

The inner fin for a heat exchanger according to the present invention has a configuration in which a cross-sectional area of the concave-shaped channel or the inverted concave-shaped channel is made constant.

The inner fin for a heat exchanger according to the present invention has a configuration in which the concave-shaped channel is formed in a V shape, and the inverted concave-shaped channel is formed in an inverted V shape.

Here, the V-shaped channel refers to a channel (includes a V shape, an inverted trapezoidal shape, etc.) whose width is narrowed toward the bottom part 12, and the inverted V-shaped channel 18 refers to a channel (includes an inverted V shape, a trapezoidal shape, etc.) whose width is narrowed toward the top part 10.

The inner fin for a heat exchanger according to the present invention has a configuration in which, with respect to an interval (R) between the top part 10 and the bottom part 12, a ratio (P/R) of an interval (P) between the top part 10 and a top part 25 of the upward slope part 28 is set to 0.4 or less, and preferably a range from 0.1 to 0.4.

The inner fin for a heat exchanger according to the present invention has a configuration in which, with regard to the upward slope part 28 of the wall plate part, a gradient ($\alpha$) of the upward slope part is set to a range of 15° to 60°, and preferably a range of 30° to 50°.

The inner fin for a heat exchanger according to the present invention has a configuration in which, with respect to an angle at which the top part 25 of the upward slope part 28 of the wall plate part is formed, an oblique angle ($\beta$) inclined toward a direction of the opposite wall plate part is set to a range of 0° to 75°, preferably a range of 30° to 60°, and more preferably a range of 35° to 50°.

Advantageous Effects of the Invention

According to the inner fin for the heat exchanger relating to the present invention, the inner fin adopts a configuration in which the recessed part of the wall plate part is formed with the chevron-shaped part made up of the upward slope part that bulges in the direction of the wall plate part facing the wall plate part and ranges from the base part to the top part and the downward slope part that passes downward from the top part to the neighboring base part. Thus, an effect that the heat exchange of the place close to, especially, the tube of the inner fin is enhanced, an effect that the heat exchange is accelerated as whole, and an effect that the high heat-radiation performance can be maintained over a long period are exerted.

According to the inner fin for the heat exchanger relating to the present invention, the inner fin adopts a configuration in which the recessed part of the wall plate part is formed with the upward slope part that bulges in the direction of the wall plate part facing the wall plate part and ranges from the base part to the top. Thus, an effect that the heat exchange of the place close to, especially, the tube of the inner fin is enhanced, an effect that the heat exchange is accelerated as whole, and an effect that the high heat-radiation performance can be maintained over a long period are exerted.

According to the inner fin for the heat exchanger relating to the present invention, the inner fin adopts a configuration in which the valley-shaped part is formed at the projected part of the wall plate part, in which with respect to the chevron-shaped part formed at the recessed part of the wall plate part, the projected part of the other wall plate part facing the wall plate part is formed with the valley-shaped part, and in which the recessed part is formed with the chevron-shaped part. Thus, in addition to the above effects, there are effects that there is no directivity of circulation of the gas, and an effect of preventing the erroneous assembly during production and contributing to workability and productivity.

According to the inner fin for the heat exchanger relating to the present invention, since the cross-sectional area of the concave-shaped channel and the inverted concave-shaped channel is made constant, there are an effect that the gas pressure loss is inhibited, an effect that the flow of the gas becomes good and the heat exchange efficiency is increased, an effect that the occurrence of a drift or the like which a flow velocity is changed (decelerated) to generate is inhibited, and an effect that a fear of accumulation or the like of soot or PM is also removed when the heat exchange of the exhaust gas or the like is performed.

BRIEF DESCRIPTION OF THE DRAWINGS

FIGS. 8A and 8B are explanatory views of a flow of an exhaust gas in the inner fine, wherein FIG. 8A illustrates a flow in a partial perspective view of the fin, and FIG. 8B illustrates a flow in a partial sectional view of the fin.

MODES FOR CARRYING OUT THE INVENTION

Hereinafter, embodiments of the present invention will be described on the basis of the drawings.

Figure 1:
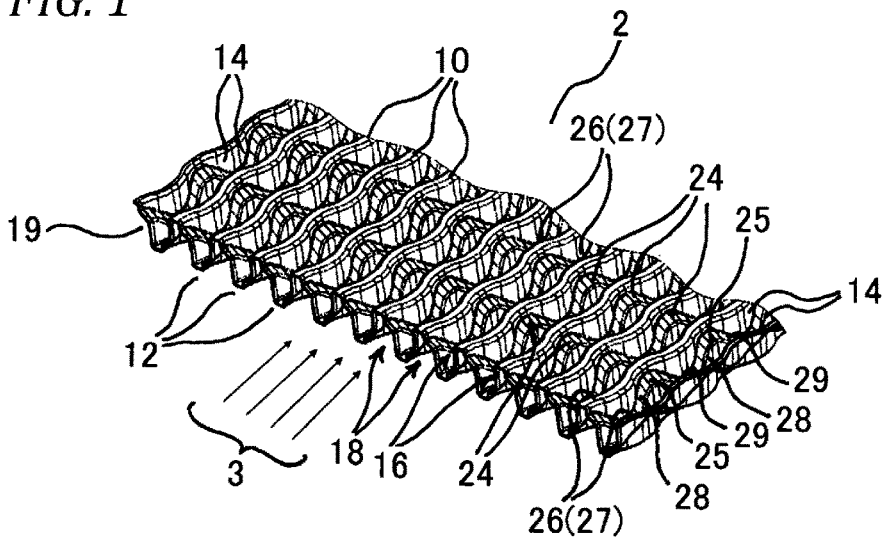
FIG. 1 is a perspective view illustrating an inner fin according to an embodiment.
Figure 2:
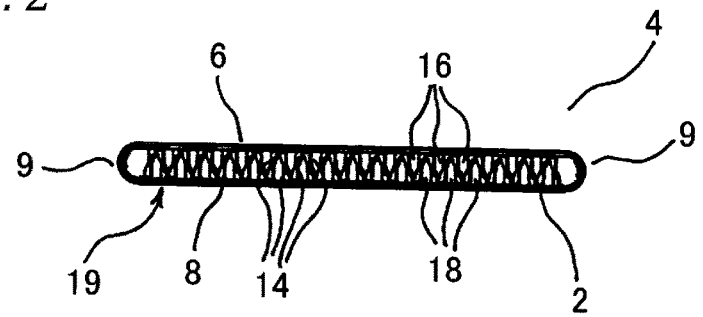
FIG. 2 is a view illustrating a state in which the inner fin is inserted into and installed in a tube.

As illustrated in FIGS. 1 and 2, an inner fin 2 (hereinafter referred to as a fin 2) according to the embodiment is used to be inserted into a flat tube 4 allowing passage of an exhaust gas 3 in an EGR cooler acting as a heat exchanger mounted in a vehicle. The tube 4 has tabular upper and lower plate parts 6 and 8, and left and right lateral plate parts 9 of these upper and lower plate parts. Numerous channels of the exhaust gas 3 which are divided into subdivisions are defined by the fin 2 that is inserted into and installed in the tube 4.

The numerous tubes 4 are stacked inside the EGR cooler at predetermined intervals, and heat radiation from the exhaust gas 3 allowing passage of the inside of the tubes 4 to a refrigerant (a coolant or the like) flowing the outside of the tubes 4 is performed.

The fin 2 is bent and obtained by, for instance, pressing a plate made of a sheet of SUS (stainless steel). Likewise, the tube 4 is also made of SUS. As a material other than the material for the fin 2 and the tube 4, a material having resistance to corrosion is good, and a light metal such as aluminum may be used for a metal.

Figure 3A:
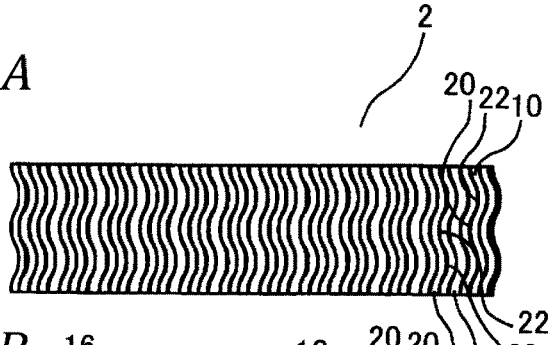
FIGS. 3A to 3C are views illustrating a top of the inner fin, a front of the inner fin, and a side of the inner fin, respectively.
Figure 3C:
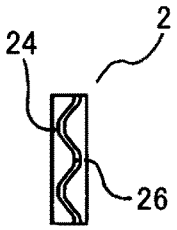
Figure 3B:
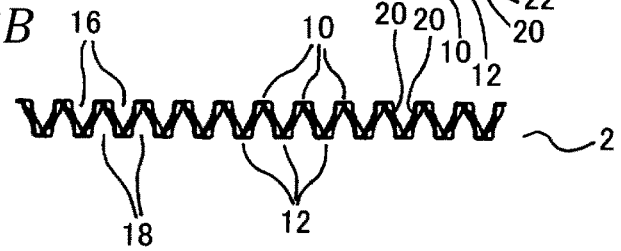

As also illustrated in FIGS. 3 and 4, the fin 2 has top parts 10 that are in contact (braze) with the upper plate part 6 of the tube 4, bottom parts 12 that are in contact (braze) with the lower plate part 8, and a pair of left and right wall plate parts 14 that partition the top and bottom parts at a predetermined pitch. A V-shaped channel 16 and an inverted V-shaped channels 18 are formed between the pair of wall plate parts 14 in a shape in which a cross section (verticality) in a circulating direction of the exhaust gas 3 is alternately repeated in a V shape and an inverted V shape.

The V-shaped channel 16 refers to a channel whose width is narrowed toward the bottom part 12, and the inverted V-shaped channel 18 refers to a channel whose width is narrowed toward the top part 10. Here, for example, as to the V-shaped channel 16, a width of the bottom part 12 in relation to a width between the neighboring top parts 10 is set to a ratio of about 4:1. As to the inverted V-shaped channel 18, reversely a width between the neighboring bottom parts 12 in relation to a width of the top part 10 is set to a ratio of about 1:4.

Hereinafter, for convenience, the fin 2 will be described on the basis of a state (FIG. 1 or the like) in which the fin 2 is horizontally located. A main flow of the exhaust gas 3 is set to a horizontal direction (with meandering), and a direction in which inflow ports 19 of the exhaust gas 3 of the fin 2 are lined up refers to a rightward/leftward (direction) or a transverse (direction). A side of the inflow ports 19 is set to a front portion of the fin 2, and a height (thickness) direction of the fin 2 refers to an upward/downward direction.

Meanwhile, the top part 10 of the fin 2 has a shape in which its surface having a fixed narrow width is elongatedly formed, and the bottom part 12 is also the same as the top part. The top and bottom parts 10 and 12 of the fin 2 together meander left and right and are formed in a wave shape. The wall plate parts 14 are also formed in the same serpentine shape in harmony with the serpentine shape of the top and bottom parts 10 and 12, and the main channel of the exhaust gas 3 formed between the wall plate parts 14 is a form that meanders left and right.

The fin 2 is formed in a wave shape in which the wall plate parts 14 are bent left and right in a serpentine shape and projected parts 20 shaped to be projected from the sideways with respect to the channel and recessed parts 22 shaped to be recessed sideways with respect to the channel are repeated and continued. In this way, the projected part 20 and the recessed part 22 have for instance the shape of the left and right wall plate parts 14 of one of the V-shaped channels 16, and refer to parts of a projected shape and parts of a recessed shape when viewed from the channel For this reason, with respect to the recessed part 22 of arbitrary one of the wall plate parts 14 of the channel, the projected part 20 is formed at the other wall plate part 14 (directly across) facing the one wall plate part. With respect to the projected part 20 of the one wall plate part 14, the recessed part 22 is formed at the other wall plate part 14 (directly across).

The main flow of the exhaust gas 3 becomes a flow meandering left and right due to the shapes (the projected part 20 and the recessed part 22) of the wall plate parts 14 when flowing through the V-shaped channels 16 (this is also the same as in the inverted V-shaped channels 18) of the fin 2. However, at this time, the flow of the exhaust gas 3 goes beyond the projected parts 20, a negative pressure region is generated around the recessed parts 22 continued thereto.

Meanwhile, as illustrated in FIGS. 4A to 4E, a chevron-shaped part 24 bulged in a direction of the other wall plate part 14 facing the recessed part 22 is provided for the recessed part 22 of the one wall plate part 14 forming the V-shaped channel 16 of the fin 2. The chevron-shaped part 24 has a shape made up of an upward slope part 28 leading to a top part 25 from a base part 27 and a downward slope part 29 leading to the neighboring base part 27 from the top part 25.

The base part 27 is disposed and formed at a position that is slightly higher than the bottom part 12 of the fin 2, and the top part 25 is disposed and formed at a position that is slightly lower than the top part 10 of the fin 2.

A valley-shaped part 26 formed to bulge in a direction of the other wall plate part 14 facing the projected part 20 is provided for the projected parts 20 of the one wall plate part 14. The valley-shaped part 26 has a shape made up of the downward slope part 29 forming the chevron-shaped part 24, the base part 27, and the upward slope part 28 of another chevron-shaped part 24 that is adjacent to the chevron-shaped part 24 and is equally formed.

The chevron-shaped part 24 has a bilaterally symmetric shape, and the upward slope part 28 and the downward slope part 29 are formed to be symmetrical with respective to a normal from the top part 25. The chevron-shaped part 24 and the valley-shaped part 26 are formed at the recessed part 22 and the projected part 20 along the wall plate part 14 in a shape in which the chevron-shaped part 24 and the valley-shaped part 26 are alternately repeated.

In this way, the fin 2 adopts a configuration in which the recessed part 22 of the wall plate part 14 is a region in which the negative pressure is generated, but the chevron-shaped part 24 is formed at the recessed part 22.

The chevron-shaped part 24 and the valley-shaped part 26 are also equally formed with respect to the other wall plate part 14.

The other wall plate part 14 is formed in a shape in which the valley-shaped part 26 is formed at a part facing the chevron-shaped part 24 of the one wall plate part 14, the chevron-shaped part 24 is formed at a part facing the valley-shaped part 26 of the one wall plate part 14, and the chevron-shaped part 24 and the valley-shaped part 26 are alternately repeated.

With respect to the other V-shaped channel 16, the shapes of both the wall plate parts 14 are identical to those of the one wall plate part 14 and the other wall plate part 14. When viewed upside down, the inverted V-shaped channel 18 has the same shape as the V-shaped channel 16, and the shapes of the wall plate parts 14 are also identical.

The specific shapes (the chevron-shaped part 24, the channel, etc.) of the fin 2 will be described on the basis of the description of FIGS. 4A to 4E. To examine a change in characteristic when the shapes of the fin are partly changed, an in-house test is performed on an amount (Q) of heat radiation and pressure loss ($\Delta P$) of the channel in that case regarding each shape of the fin 2, and thus a preferred range or the like of each shape is prescribed on the basis of results of the test.

First, with regard to an arranged position of the chevron-shaped part 24 formed in the wall plate part 14 of the fin 2, a ratio (P/R) of an interval (P) between the top part 10 and the top part 25 of the chevron-shaped part 24 to an interval (R) between the top part 10 and the bottom part 12 of the fin 2 is set to 0.2 here. The interval (P) is also an interval between the bottom part 12 and base part 27 (whose backside is the top part 25) of the valley-shaped part 26 (whose backside is the chevron-shaped part 24).

The ratio (P/R) is 0.4 or less, preferably a range of 0.1 to 0.4, and more preferably a range of 0.1 to 0.35. According to the results of the test, the reason is that great pressure loss ($\Delta P$) is not observed within the range. In the range of the ratio (P/R), an upward flow and a spiral vortex flow are favorably generated.

Figure 4C:
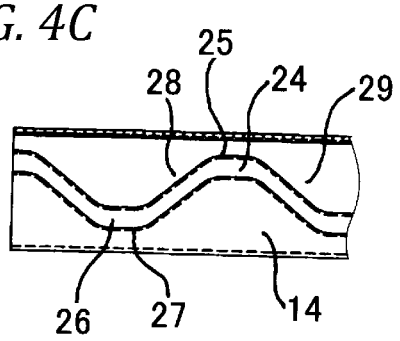
FIGS. 4A to 4E are views illustrating a top of the inner fine, a front of the inner fine, a cross section of the inner fine taken along line C-C, a cross section of the inner fine taken along line D-D, and a cross section of the inner fine taken along line B-B, respectively.
Figure 4B:
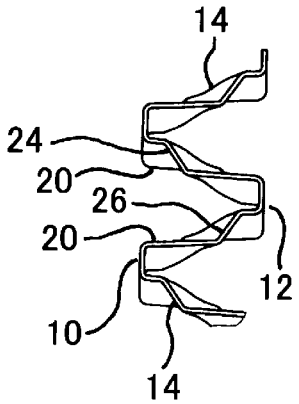
Figure 4A:
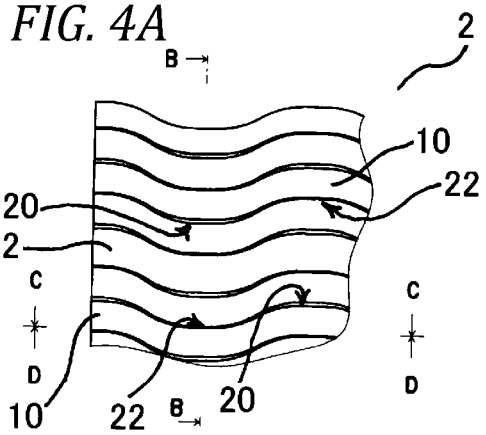
Figure 4D:
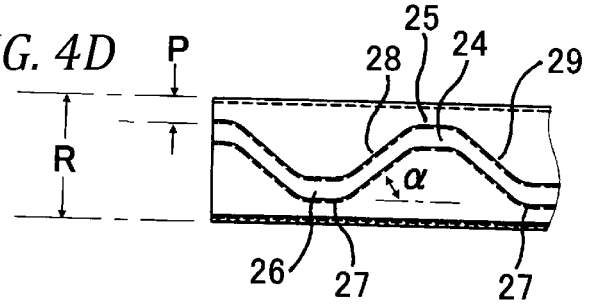

As illustrated in FIG. 4D, in a range in which a gradient ($\alpha$) of the upward slope part 28 of the chevron-shaped part 24 is 15° to 60°, and preferably 30° to 50°, a favorable upward flow is generated.

Figure 4E:
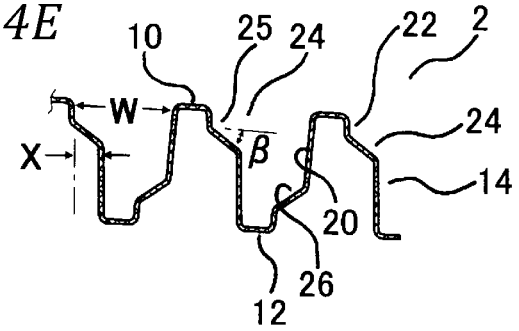

Further, as illustrated in FIG. 4E, the chevron-shaped part 24 has a shape in which the wall plate part 14 is formed to bulge. However, with respect to an oblique angle ($\beta$: an angle with respect to a horizontal line) that is inclined toward the direction of the wall plate part 14 across from the top part 25 (an upper end) of the chevron-shaped part 24 regarding an angle relating to the bulging, in a range of 0° to 75°, preferably a range of 30° to 60°, and more preferably a range of 35° to 50°, a good upward flow is generated. According to the results of the test, the reason is that, in this range, a high amount (Q) of heat radiation is maintained, whereas a rise in the pressure loss ($\Delta P$) is also inhibited.

In the V-shaped channel 16 of the fin 2, a width of the channel is a maximum between the neighboring top parts 10. With respect to a width (W) between the top parts 10, a bulging width (X) of the chevron-shaped part 24 is set to about ⅓ (X=W/3) here. This is also the same as in the inverted V-shaped channel 18 of the fin 2. A bulging width of the channel is set in consideration of left and right balance, or the like in the channel of the fin 2.

With regard to periods of the channels (the V-shaped channel 16 and the inverted V-shaped channel 18) of the fin 2 which repeatedly meander left and right, a length of one period is set to 5 mm to 30 mm, and preferably 10 mm to 20 mm. This length is also not changed by the other dimensions of the fin 2 itself. This is because, according to the results of the test, a rise in the pressure loss (ΔP) is relatively inhibited in a range of the above length in relation to a rise in the amount (Q) of heat radiation.

Here, in a relation between the amount (Q) of heat radiation and the pressure loss (ΔP), a product in the related art has a relation of a so-called trade-off that, if the amount (Q) of heat radiation is to be increased, the pressure loss (ΔP) simultaneously becomes high. However, with regard to the fin 2, even in a state in which the pressure loss (ΔP) is made to be relatively low, a high amount (Q) of heat radiation is obtained. For this reason, an excellent effect that the amount (Q) of heat radiation and the pressure loss (ΔP) are advantageous together can be obtained.

Figure 5A:
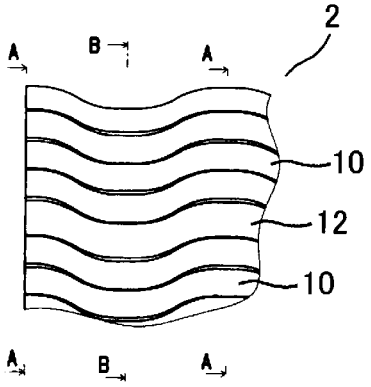
FIGS. 5A to 5C are views illustrating a top of the inner fine, a cross section of the inner fine taken along line A-A, and a cross section of the inner fine taken along line B-B, respectively.
Figure 5B:
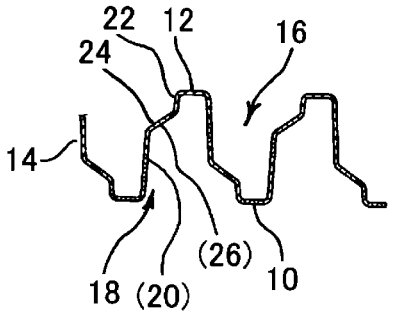

Further, in the fin 2, as illustrated in FIG. 5B for a cross section taken along line A-A of FIG. 5A, with regard to the chevron-shaped part 24 formed at the recessed part 22 of the one wall plate part 14 forming the V-shaped channel 16 of the fin 2, when the fin 2 is turned upside down and the inverted V-shaped channel 18 is viewed as the V-shaped channel 16, a backside of the plate of the wall plate part 14 has a shape in which the recessed part 22 becomes an opposite projected part (20) and a valley-shaped part (26) is formed at the opposite projected part (20).

Figure 5C:
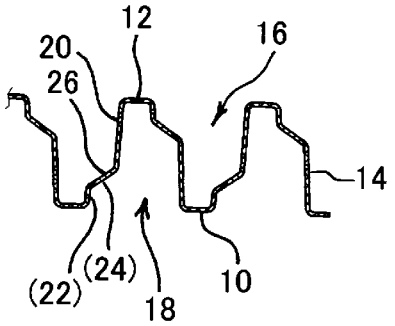

As illustrated in FIG. 5C for a cross section taken along line B-B of FIG. 5A, with regard to the valley-shaped part 26 formed at the projected part 20 of the one wall plate part 14, when viewed with the fin 2 turned upside down, a backside of the plate of the wall plate part 14 has a shape in which the projected part 20 becomes an opposite recessed part (22) and a chevron-shaped part (24) is formed at the opposite recessed part (22).

In this way, the serpentine shape of the V-shaped channel 16 of the fin 2, and the shapes of the chevron-shaped part 24 and the valley-shaped part 26 that are formed at the left and right wall plate parts 14 are identical to the shape of the V-shaped channel 16 when the fin 2 is turned upside down. The top parts 10 and the bottom parts 12 of the fin 2 become the bottom parts 12 and the top parts 10 when the fin 2 is turned upside down.

For this reason, even when the fin 2 is turned upside down, the fin 2 has the same exterior shape and no vertical directivity is present only by changing the V-shaped channel 16 (the inverted V-shaped channel 18) into the inverted V-shaped channel 18 (the V-shaped channel 16).

With regard to the channel of the exhaust gas 3, any of the V-shaped channel 16 and the inverted V-shaped channel 18 is a channel in which the wall plate part 14 is continuous. The shapes of the recessed part 22 and the projected part 20, and the chevron-shaped part 24 and the valley-shaped part 26 formed at the recessed part 22 and the projected part 20 depending on the serpentine shape of the wall plate part 14 have a form in which a period of the same shape is repeated. A shape of the front and rear (the flow direction) using the center of the top part 25 of the chevron-shaped part 24 as an axis is symmetrical, and directivity of the channel is not present.

With regard to the chevron-shaped part 24 formed at the wall plate part 14 of the fin 2, the upward slope part 28 generates an upward flow with respect to the flow of the exhaust gas 3. However, when the fin 2 is reversed back and forth, a place that is the downward slope part 29 of the chevron-shaped part 24 reversely becomes the upward slope part 28, and generates an upward flow with respect to the flow of the exhaust gas 3. In this way, no directivity is present in the forward/backward direction of the fin 2 (the circulating direction of the exhaust gas 3), and no directivity is present in the leftward/rightward direction of the fin 2.

When the fin 2 is made free from the directivity, erroneous assembly occurring especially when produced such as when the fin 2 is assembled can be prevented, management of the fin 2 is also facilitated in a producing process, and workability and productivity are improved.

Figure 6A:
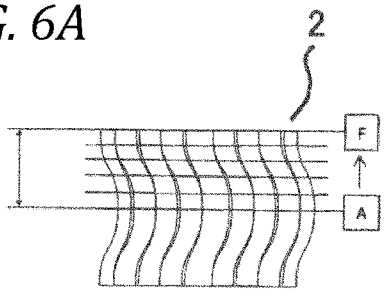
FIGS. 6A to 6C are views illustrating a top of the inner fine, a cross section of regions (A to F) of the top, and an explanatory view in one cross section, respectively.
Figure 6B:
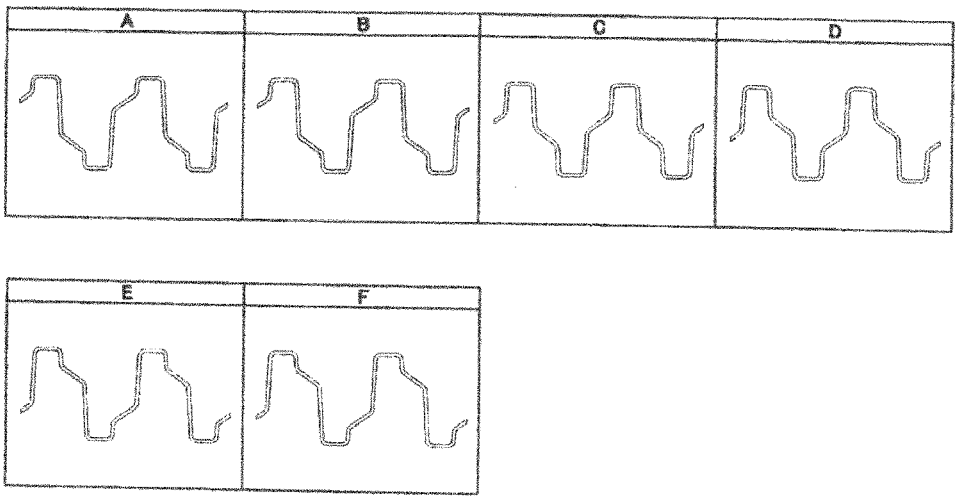
Figure 6C:
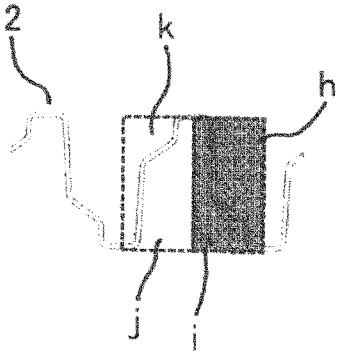

FIGS. 6A to 6C relate to ventilation cross sections (cross sections perpendicular to the channel directions) of regions A to F of the channel of the fin 2 (FIG. 6A), and FIG. 6B shows sectional views of the regions A to F. Here, for example, a sectional view A is divided into right regions (h and i) that are hatched and left regions (j and k) that are not hatched as shown in FIG. 6C. Here, when the left regions are subjected to rotation of 180 degrees (on the same plane), the left regions have a shape in which the left regions and the right regions become symmetry with respect to a line (a boundary line).

For this reason, the right region (h) and the left region (j) become the same (area), and the right region (i) and the left region (k) also become the same (area). Therefore, with regard to the sectional view A, cross-sectional areas of both channels of the V-shaped channel 16 and the inverted V-shaped channel 18 are the same. This is also the same as in the other regions "B" to "F."

That is, ventilation cross-sectional areas (areas of the cross sections perpendicular to the channel directions) of the V-shaped channels 16 of the fin 2 are constant at any place. This is also the same as in the inverted V-shaped channels 18 of the fin 2. The ventilation cross-sectional areas of the V-shaped channel 16 and the inverted V-shaped channel 18 of the fin 2 are the same. For this reason, all the channels (the V-shaped channels 16 and the inverted V-shaped channels 18) of the fin 2 are constant in the ventilation cross-sectional area.

In this way, the ventilation cross-sectional areas of the fin 2 are made constant. Thereby, a flow rate of the exhaust gas 3 flowing in the channel is constant in any region, the flow of the exhaust gas 3 gets better, and gas pressure loss is inhibited. Since heat exchange in each of the channels of the fin 2 is favorably performed, the amount of heat radiation as the heat exchanger is enhanced.

Further, since a flow velocity of the exhaust gas 3 is also constant in any channel of the fin 2, occurrence of a drift caused by a change (deceleration or the like) of the flow velocity is inhibited, and a fear of accumulation or the like of soot is also removed. The fin 2 has a shape in which the wall plate parts 14 are continuous in any direction. Considering this point, there is no fear of accumulation or the like of soot, and durability is also excellent.

The fin 2 is used by inserting it into the tube 4, brazing the top parts 10 and the bottom parts 12 to an inner surface of the tube 4, joining the top parts 10 of the fin 2 to the upper plate part 6 of the tube 4, and joining the bottom parts 12 of the fin 2 to the lower plate part 8 of the tube 4.

Figure 7A:
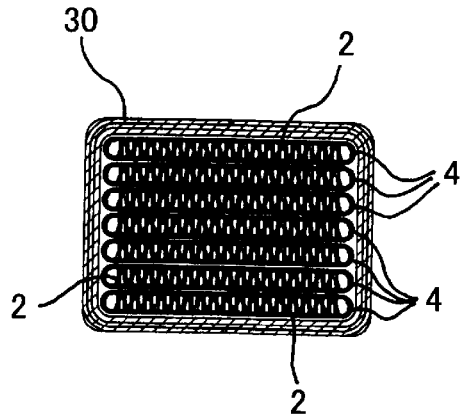
FIGS. 7A to 7C are explanatory views illustrating a state in which the tube into which the inner fin is inserted is installed inside the heat exchanger for EGR.
Figure 7B:
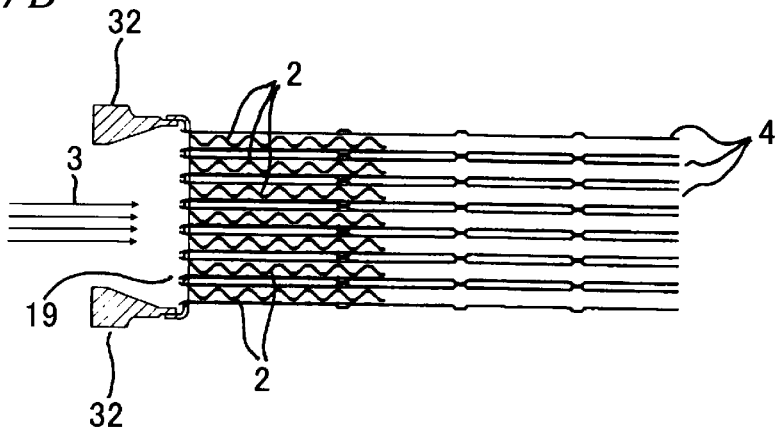
Figure 7C:
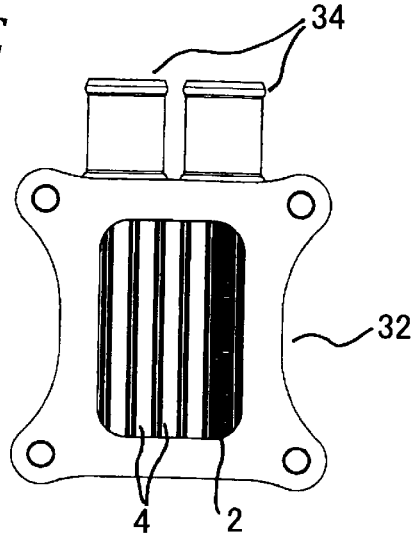

FIGS. 7A to 7C illustrate a state in which the tubes 4 into and in which the fins 2 are inserted and installed is installed in the heat exchanger (the EGR cooler). The tubes 4 are disposed in a shell 30 that is a container of the heat exchanger in a state in which the tubes are superimposed in a plurality of layers (here, seven layers). The tubes 4 in the shell 30 have a fixed interval provided at each layer. An interval is also provided between the shell 30 and the tubes 4, and a refrigerant (a coolant) circulates through an interval between the tubes 4 and the interval between the shell 30 and the tubes 4.

The exhaust gas 3 flows in from a header 32 mounted on a front portion of the shell 30, circulates through each channel of the fin 2 from the inflow port 19 of each tube 4, is cooled between the channels, and flows out from a header of a rear portion of the shell 30. The coolant is supplied by water pipes 34 (for an inlet and an outlet) communicating with the shell 30.

Here, a function of the heat exchange of the fins 2 inserted into and installed in the tubes 4 will be described.

In the heat exchanger, the coolant flows through an outer circumferential portion of each of the tubes 4, the exhaust gas 3 circulates through the V-shaped channels 16 and the inverted V-shaped channels 18 of each of the fins 2, and the heat exchange for cooling the exhaust gas 3 is performed.

In this case, a place that is relatively adjacent to the upper plate part 6 or the lower plate part 8 of the tube 4 in the wall plate parts 14 of the fin 2 is subjected to an influence (heat transfer) from the tube 4 cooled by the coolant, and thus a low temperature is maintained close to the coolant, whereas the influence (heat transfer) from the tube 4 is small and a temperature is also increased in the vicinity of the middle of the vertical direction of the wall plate parts 14 of the fin 2.

Therefore, considering cooling of the exhaust gas 3 caused by the fin 2 and the tube 4, it is efficient for a lot of flow of the exhaust gas 3 to be collected or concentrated on a region close to the tube 4 in the fin 2. In conjunction with this, it is effective to direct the flow of the exhaust gas 3 to the region close to the tube 4.

Here, the flow of exhaust gas 3 circulating through the periphery of the fin 2 mounted in the tube 4 with regard to the fin 2 will be described.

Figure 8A:
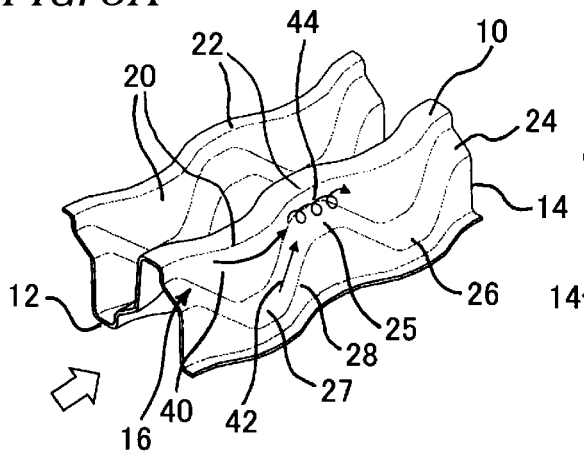

FIG. 8A illustrates the flow of exhaust gas 3 circulating around the chevron-shaped part 24 formed in the wall plate part 14 regarding the V-shaped channel 16 of the fin 2. Here, in the channels of the fin 2, a flow of exhaust gas 3 which meanders left and right and is affected by the projected part 20 and the recessed part 22 is defined as a primary flow 40, and a flow that flows around the chevron-shaped part 24 of the wall plate part 14 of the fin 2 is defined as a secondary flow 42.

At this time, when a flow (especially, the vicinity of the upper and lower tubes 4) of the primary flow 40 of the fin 2 flows across the projected part 20, a negative pressure occurs. Since the recessed part 22 is located at a tip of the projected part 20, a region of the recessed part 22 becomes a negative pressure. Due to the negative pressure, a flow is pulled to the region of the recessed part 22. Therefore, the primary flow 40 flows in a state in which the flow meandering left and right is pulled to the negative pressure region of the recessed part 22. Likewise, the secondary flow 42 flows in a state in which the flow meandering left and right is pulled by the negative pressure.

The flow of the secondary flow 42 is deflected close to the wall plate part 14 of the recessed part 22 at which the negative pressure occurs. For this reason, the flow of the secondary flow 42 becomes an upward flow that is affected by the upward slope part 28 of the chevron-shaped part 24 formed at the recessed part 22 of the wall plate part 14, flows up the upward slope part 28, and changes an angle upward and in a direction of the upper plate part 6 of the tube 4.

Further, the secondary flow 42 joins the primary flow 40 flowing along the negative pressure region of the recessed parts 22. At this time, since the secondary flow 42 relatively flows around the wall plate part 14 of the fin 2 (and around the upper plate part 6 of the tube 4), the secondary flow 42 becomes a flow that surrounds a periphery of the primary flow 40. In conjunction with this, the primary flow 40 also becomes a spiral vortex flow 44 that swirls along with the secondary flow 42 and flows in a running direction of the channel. The spiral vortex flow 44 becomes a flow that swirls a range close to the top part 25 of the chevron-shaped part 24 and the upper plate part 6 of the tube 4 within the wall plate part 14 of the fin 2. In the case of the other wall plate part 14 facing the wall plate part 14, the same spiral vortex flow 44 occurs as well.

The V-shaped channel 16 of the fin 2 has been described above. However, in the case of the inverted V-shaped channel 18 of the fin 2, the swirling flow is the same, and the spiral vortex flow 44 caused by the primary flow 40 and the secondary flow occurs, and becomes a flow that swirls a range close to the lower plate part 8 of the tube 4.

Figure 8B:
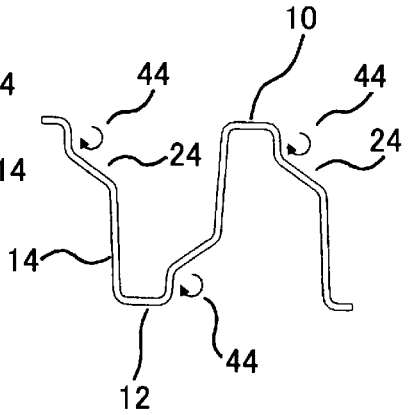

As illustrated in FIG. 8B, the spiral vortex flow 44 becomes a flow that swirls around the upper and lower plate parts of the tube 4 within the wall plate part 14 of the fin 2. In the wall plate part 14 of the fin 2, especially a place close to the upper plate part 6 or the lower plate part 8 of the tube 4 greatly receives an influence (heat transfer) of the tube 4 (cooled by the coolant). For this reason, when the spiral vortex flow 44 is forced to occur in this region, the efficiency of cooling is good, and the cooling of the exhaust gas 3 is effectively performed.

Since a part of the secondary flow 42 becomes an upward flow directed from the negative pressure region to the upper plate part 6 of the tube 4, the upward flow circulates around the top part 10 of the fin 2, and simultaneously circulates around the upper plate part 6 of the tube 4. This is also the same as in the inverted V-shaped channel 18, and a part of the secondary flow 42 becomes a downward flow directed to the lower plate part 8 of the tube 4.

Since the coolant flows outside the tube 4, and since the region close to the tube 4 has a high heat exchanging (cooling) effect of the exhaust gas 3, the cooling of the exhaust gas 3 becoming the upward flow (and the downward flow) is performed efficiently and effectively. In this way, in the fin 2, the spiral vortex flow 44 and the upward flow (and the downward flow) are generated by, for instance, the upward slope part 28 of the chevron-shaped part 24, and the heat exchange from which high heat-radiation performance is obtained is accelerated.

In addition, in the fin 2, the spiral vortex flow 44 occurs at the recessed part 22 (at which the chevron-shaped part 24 is formed) of the channel for the exhaust gas 3, and the spiral vortex flow 44 is a vortex proceeding in the circulating direction of the exhaust gas 3. Thus, there is no fear of incurring stagnation and accumulation of the soot at the recessed part 22. The problem that the soot or the like is stagnated and accumulated by occurrence of a return vortex, which is indicated in the problem of the wavy fin in the related art, is solved.

Accordingly, according to the above embodiment, the heat exchange of the place close to, especially, the tube 4 of the fin is enhanced, and the heat exchange is accelerated as whole. The high heat-radiation performance can be maintained over a long period. Since there is no directivity of the circulation of the exhaust gas, there is an effect of preventing the erroneous assembly during production and contributing to productivity. According to the above embodiment, since the cross-sectional area of the channel is made constant, the gas pressure loss is inhibited, and the flow of the gas becomes good to increase heat exchange efficiency. The occurrence of the drift or the like which the flow velocity is changed (decelerated) to generate is inhibited, and there is an effect that a fear of accumulation or the like of soot or PM is also removed.

Figure 9:
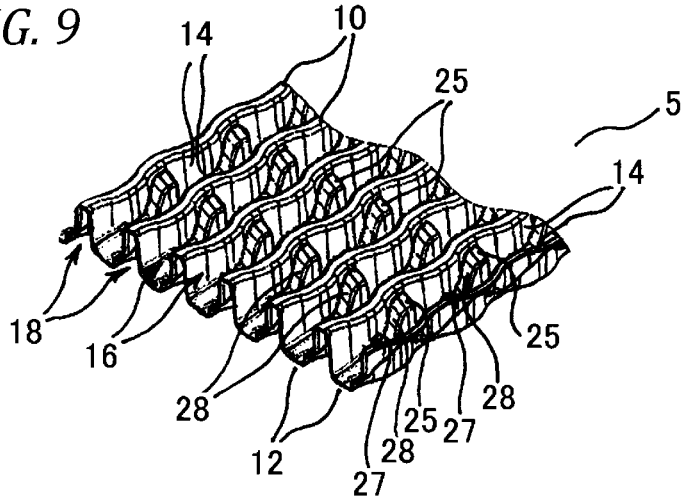
FIG. 9 is a perspective view illustrating an inner fin according to another embodiment.
Figure 10:
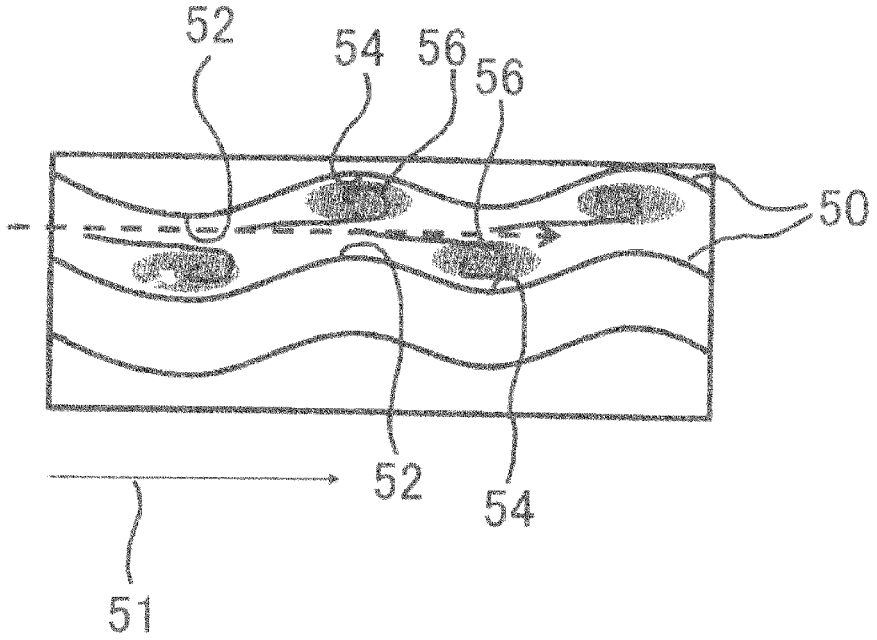
FIG. 10 is an explanatory view according to an inner fin in the related art.

FIG. 9 illustrates a second fin 5 having a shape in which it is partly different from the fin 2 in accordance with another embodiment. The fin 2 is configured such that the chevron-shaped part 24 is formed at the recessed part 22 of the wall plate part 14. However, in place of the chevron-shaped part 24, the second fin 5 is configured such that only an upward slope part 28 ranging from a base part 27 up to a top part 25 is formed at the recessed parts 22, and a downward slope part 29 is not provided.

With respect to the upward slope part 28 formed at a wall plate part 14 of the second fin 5, an upward slope part 28 is equally formed at recessed parts 22 of another wall plate part 14 facing the wall plate part 14. The upward slope part 28 of the second fin 5 is repeatedly formed along each of the wall plate parts 14.

In the second fin 5, the wall plate parts 14 (shapes such as facing, and repeating) that are basic shapes of the channel, V-shaped channel 16, inverted V-shaped channel 18, top parts 10, bottom parts 12, projected parts 20, recessed parts 22, and a material are the same as in the fin 2, are given the same reference signs, and detailed description thereof will be omitted.

A flow of the exhaust gas 3 circulating through the upward slope part 28 of the second fin 5 is equal to the flow of the exhaust gas 3 circulating through the upward slope part 28 constituting the chevron-shaped part 24 of the fin 2. A spiral vortex flow 44 and an upward flow are also effectively generated in the upward slope part 28 of the second fin 5. For this reason, like the fin 2, in the second fin 5, heat exchange from which high heat-radiation performance is obtained is accelerated, and there is no fear of incurring stagnation and accumulation of soot or the like.

The channel of the fin 2 (or the second fin 5) according to the above embodiment is used as the channel having the V-shaped cross section and whose width is narrowed toward the bottom part or the channel having the inverted V-shaped cross section and whose width is narrowed toward the top part. As another channel, a channel having a U-shaped cross section (the channel width of the top part and the channel width of the bottom part are approximately the same) or a channel having an inverted U-shaped cross section may be adopted.

In comparison with the V-shaped channel, the U-shaped (and inverted U-shaped) channel is configured such that the area of the fin made up of the wall plate parts is slightly small, and the heat-radiation performance is reduced as much. However, due to the spiral vortex flow or the like caused by the shape of the chevron-shaped part (the upward slope part), sufficient heat-radiation performance can be expected.

The fin 2 (or the second fin 5) according to the above embodiment has the shape in which the wall plate part forming the channel of the exhaust gas 3 is formed in the wave shape meandering left and right, the chevron-shaped part and the valley-shaped part are formed at the wall plate part (the recessed part and the projected part), and the V-shaped (U-shaped) channel and the inverted V-shaped (U-shaped) channel are formed between the pair of wall plate parts.

In contrast, as a fin according to a mode of another channel, a mode in which the wall plate part forming the channel of the exhaust gas 3 is formed in a linear shape that does not meander left and right (a linear channel) and the chevron-shaped part and the valley-shaped part are formed at the wall plate part may be adopted. In the linear channel, all of a shape and a period in which the chevron-shaped part (the upward slope part) and the valley-shaped part formed at the wall plate part are repeated, directivity, a constant cross-sectional area, an arrangement shape, a material, insertion into the tube 4, etc. are the same as those of the fin 2.

In the fin according to the mode of the other channel, the upward flow and the spiral vortex flow can be generated by the chevron-shaped part. In comparison which the fin 2 in which the wall plate part is formed in the wave shape, the cooling performance is deteriorated. However, when the fin is adopted, since pressing or the like is relatively easily performed, there is a merit in the aspect of production.

While the present invention has been described in detail with reference to the specific embodiments, it is apparent to those skilled in the art that the present invention can be modified or altered in various ways without departing the spirit and scope of the present invention.

This application is based on Japanese Patent Application No. 2015-130837, filed on Jun. 30, 2015, the content of which is incorporated herein by reference.

DESCRIPTION OF REFERENCE NUMERALS

2, 5 Inner fin (fin)
3 Gas (exhaust gas)
4 Tube
6 Upper plate part
8 Lower plate part
10 Top part
12 Bottom part
14: Wall plate part
16 Concave channel (V-shaped channel)
18 Inverted concave channel (inverted V-shaped channel)
20 Projected part
22 Recessed part
24 Chevron-shaped part
25 Top part
26 Valley-shaped part
27 Base part
28 Upward slope part
29 Downward slope part
40 Primary flow
42 Secondary flow
44 Spiral vortex flow

The invention claimed is:

1. An inner fin for a heat exchanger which performs heat exchange of a gas, the inner fin being inserted into a tube in which a space is flat between an upper plate part and a lower plate part, wherein a plate is made up of a top part that is in contact with the upper plate part of the tube, a bottom part that is in contact with the lower plate part of the tube, and a wall plate part that partitions a space between the top and bottom parts, and a channel having a concave-shaped cross section and a channel having an inverted concave-shaped cross section are alternately repeated as channels of the gas by a pair of the wall plate parts facing each other;

the wall plate part for each of the channels has a shape in which the wall plate part is bent left and right in a serpentine shape and projected and recessed parts thereof are alternately repeated and formed; and the recessed part of the wall plate part is formed with a chevron-shaped part made up of an upward slope part that bulges in a direction of the wall plate part facing the wall plate part and ranges from a base part to the top part and a downward slope part that passes downward from the top part to a neighboring base part.

2. An inner fin for a heat exchanger which performs heat exchange of a gas, the inner fin being inserted into a tube in which a space is flat between an upper plate part and a lower plate part, wherein a plate is made up of a top part that is in contact with the upper plate part of the tube, a bottom part that is in contact with the lower plate part of the tube, and a wall plate part that partitions a space between the top and bottom parts, and a channel having a concave-shaped cross section and a channel having an inverted concave-shaped cross section are alternately repeated as channels of the gas by a pair of the wall plate parts facing each other;

the wall plate part for each of the channels has a shape in which the wall plate part is bent left and right in a serpentine shape and projected and recessed parts thereof are alternately repeated and formed; and the recessed part of the wall plate part is formed with an upward slope part that bulges in a direction of the wall plate part facing the wall plate part and ranges from a base part to the top part.

3. The inner fin for a heat exchanger according to claim 1, wherein the projected part of the wall plate part is formed with a valley-shaped part made up of a downward slope part that passes downward from a top part of the chevron-shaped part to a base part thereof and an upward slope part of another chevron-shaped part that is adjacent to the chevron-shaped part and is equally formed; and with respect to the chevron-shaped part formed at the recessed part of the wall plate part, the projected part of the other wall plate part facing the wall plate part is formed with the valley-shaped part, and with respect to the valley-shaped part formed at the projected part of the wall plate part, the recessed part of the other wall plate part is formed with the chevron-shaped part.

4. The inner fin for a heat exchanger according to claim 3, wherein a cross-sectional area of the concave-shaped channel or the inverted concave-shaped channel is made constant.

5. The inner fin for a heat exchanger according to claim 1, wherein the concave-shaped channel is formed in a V shape, and the inverted concave-shaped channel is formed in an inverted V shape.

6. The inner fin for a heat exchanger according to claim 1, wherein with respect to an interval between the top part and the bottom part, a ratio of an interval between the top part and a top part of the upward slope part is set to 0.4 or less, and preferably a range from 0.1 to 0.4.

7. The inner fin for a heat exchanger according to claim 1, wherein with regard to the upward slope part of the wall plate part, a gradient of the upward slope part is set to a range of 15° to 60°, and preferably a range of 30° to 50°.

8. The inner fin for a heat exchanger according to claim 1, wherein with respect to an angle at which the top part of the upward slope part of the wall plate part is formed, an oblique angle inclined toward a direction of the opposite wall plate part is set to a range of 0° to 75°, preferably a range of 30° to 60°, and more preferably a range of 35° to 50°.

* * * * *